United States Patent [19]

Thörner et al.

[11] Patent Number: 5,027,889

[45] Date of Patent: Jul. 2, 1991

[54] DUMMY BAR APPARATUS AND METHOD FOR STEEL STRIP CASTING

[75] Inventors: Hans-Otto Thörner, Meerbusch; Hans Streubel, Erkrath, both of Fed. Rep. of Germany

[73] Assignee: SMS Schloemann-Siemag Aktiengesellschaft, Düsseldorf, Fed. Rep. of Germany

[21] Appl. No.: 609,079

[22] Filed: Nov. 2, 1990

Related U.S. Application Data

[63] Continuation of Ser. No. 419,195, Oct. 10, 1989, abandoned.

[30] Foreign Application Priority Data

Oct. 10, 1988 [DE] Fed. Rep. of Germany ..... 3834410

[51] Int. Cl.[5] ..... B22D 11/08

[52] U.S. Cl. ..... 164/483; 164/425; 164/426

[58] Field of Search ..... 164/425, 426, 445, 446, 164/483

[56] References Cited

U.S. PATENT DOCUMENTS

| | | | |
|---|---|---|---|
| 3,324,934 | 6/1967 | Hess et al. | 164/426 |
| 3,372,731 | 3/1968 | Pauels et al. | 164/425 |
| 3,789,911 | 2/1974 | Bachner | 164/445 |
| 4,178,000 | 12/1979 | Kuttner | 164/445 |
| 4,685,506 | 8/1987 | Fasano | 164/446 |
| 4,719,960 | 11/1988 | Grothe et al. | 164/446 |

FOREIGN PATENT DOCUMENTS

| | | | |
|---|---|---|---|
| 195046 | 1/1958 | Austria | 164/445 |

*Primary Examiner*—Richard K. Seidel
*Assistant Examiner*—Edward A. Brown
*Attorney, Agent, or Firm*—Wolf, Greenfield & Sacks

[57] ABSTRACT

A dummy bar for use in a strip steel casting machine of the type including a continuous casting mold having a sealing plane between a pair of broad side walls and a pair of narrow side walls, and at least a first set of driven rollers or rolls located in spaced relation to and downstream of the outlet of said mold. The dummy bar is formed of a single piece of steel plate, and includes an upper contour adapted to form a cast connection with the leading end of the strip being cast, a sealing portion, and means for supporting and withdrawing the forward end of the strip from the mold. The bar, measured from the upper end of the sealing portion to the bottom of the lower portion, is longer than the spacing between the sealing plane of the mold and the common axle plane of the first roller or roller pair.

12 Claims, 3 Drawing Sheets

I-I
I
I
1
2
3
4
5
6
7
8
9
10
11
12
13
14
s
a
E1
E2

DUMMY BAR APPARATUS AND METHOD FOR STEEL STRIP CASTING

This application is a continuation, of application Ser. No. 07/419,195, filed Oct. 10, 1989, now abandoned.

BACKGROUND

I. Field of Invention

The invention relates generally to dummy bars for use in the start up of teeming in the continuous casting of strip in a steel strip casting machine of the type wherein at least a first set of driven rollers, or rolls, is disposed in spaced relation downstream from the outlet end of the mold. More particularly, the invention relates to a one-piece dummy bar including a contoured upper end adapted for connection to the forward end of the strip being cast, a sealing portion, and a lower portion adapted to engage the first set of rollers, or rolls, for the support and withdrawal the forward end of the strip from the mold.

II. Summary of the Prior Art

The use of dummy bars in the start up of teeming in the continuous casting of steel strip in a steel strip casting machine of the type wherein at least a first set of driven rollers, or rolls, is disposed in spaced relation downstream from the outlet of the mold is well known in the art. In use, the upper end of the dummy bar is located within the lower area of the mold temporarily sealing its outlet. Once the desired casting level is present in the mold and a loadable connection between the forward end of the strip and the upper end of the dummy bar has been formed, the bar facilitates the withdrawal of the forward end of the strip from the mold, and supports the strip until it engages the first set of driven rollers, or rolls.

Commonly known dummy bars include a starting head, or plug, having a contoured upper end adapted to form a connection between the itself and the forward end of the strip being cast as the melt flowing into the lower area of the mold hardens. This starting head is detachably connected to a rigid, or flexible, strand which allows the head to be withdrawn from the mold, and provides the required support for the forward end of the strip until it engages the withdrawal means directly. In addition, separate sealing means are generally provided between the starting head and the walls of the mold (at the so called sealing plane thereof) to prevent leakage of the melt and sticking of the starting head in the mold.

Multi part dummy bars of the type just described are expensive. They require special equipment for the manipulation, storage and transportation of their various components. In addition, special equipment is required to detach the cast strip from these dummy bars. Further, these special equipments are costly to acquire and maintain, and are subject to breakdowns, which can cause down periods for the entire casting operation. Still further, the assembly of such multi part dummy bars, and their disposition within the lower area of the mold, is a time consuming, and therefore costly, process.

Accordingly, it is an object of the present invention to provide a dummy bar for use with a strip casting machine, particularly a machine designed for the casting of strip having a thickness of less than 60 mm, which can be made economically.

It is also an object of the present invention to provide a dummy bar for use with a strip casting machine which is simple to manipulate, and hence timesaving to the strip casting operation as a whole.

Further, it is an object of the present invention to provide a dummy bar for use with a strip casting machine which avoids the need for special equipment for its transport and intermediate storage, and/or for the separation of the cast strip therefrom.

Still further, it is an object of the present invention to provide a dummy bar for use with a strip casting machine wherein the need for separate sealing means between the dummy bar and the broad side walls of the mold is unnecessary.

SUMMARY OF THE INVENTION

These, and other obJects of the invention, are accomplished by the provision of a one piece dummy bar comprising a single steel plate which includes an upper contour adapted for connection to the forward end of the strip being cast, a sealing portion, and a lower portion adapted to support and withdraw the forward end of the strip from the mold. In a preferred embodiment of the invention, the steel plate has a thickness dimension 2 to 4 mm smaller than the distance separating the broad side walls at the outlet of the mold. In use, the bar is disposed within the lower area of the mold such that the upper contour and at least part of the sealing portion are located within the cavity of the mold, while the remainder of the sealing portion and the lower portion extend downwardly from the outlet of the mold. Seals are located between the narrow side walls of the mold and the left and right sides of the dummy bar respectively. The length of the steel plate, measured between the upper end of the sealing portion and the bottom of the lower portion, is longer than the spacing between the sealing plane of the mold and the common plane of the axles of the first set of rolls or rollers.

This configuration permits separate sealing means between the dummy bar and the broad side walls of the mold to be dispensed with since the fast solidification of the melt in the 1 to 2 mm gaps between the dummy bar and the broad side walls creates an effective seal. In addition, a simple dummy bar construction is provided which is easy to handle and locate in the mold cavity. The same devices used to cut cast strip into desired lengths can be used to separate the strip from the bar, so special devices for that purpose are no longer required. Further, because the dummy bar of this invention is extremely economical to manufacture, it is suitable for one time, "throw away", use. Special storage and manipulation equipment therefore also may be dispensed with, thereby providing significant savings to the overall casting operation.

According to other embodiments of the invention additional cost advantages may be achieved. For example, a saving in weight, and thereby easier and simpler handling of the dummy bar, may be accomplished by forming the lower portion as a series of spaced, parallel strips, rather than as a solid plate. Similarly, multiple utilizations of the device may be facilitated by forming contours adapted for the connection of the dummy bar to the forward end of a strip at both the upper, and the lower, ends of the sealing portion. This allows the dummy bar to be simply cut off of the forward end of one cast strip by a standard strip cutting device, and thereafter, to be utilized in reverse orientation to start a subsequent cast strip. Multiple utilization can also be accomplished in the context of this invention by increasing the length of the dummy bar. Specifically, by utilizing the known facts that the height of the upper contour is h, and that the minimum length of the dummy bar must be a, one can form a dummy bar suitable for any number of uses n by increasing its length to a dimension L established by the formula $L=a+(n\times h)$. In such a case, the creation of a new connection contour is accomplished by flame cutting, or otherwise forming, a new upper contour into the uppermost part of the sealing pOrtion each time a new use of the device is required.

Further aspects of the preferred forms of the invention include the option to form the connecting contour as a series of connecting heads extending upwardly from the upper end of the sealing portion. Alternatively, the contour may comprise a series of cut-out sections provided with undercuts extending downwardly into the upper end of the sealing portion. In the latter case, the cut out openings adjacent the left and right sides of the plate may display undercuts at their outer upper edges while the inner sides thereof are slanted inwardly toward the longitudinal axis of the plate. The latter configuration allows for free shrinking of the steel strip, and avoids the creation of shrinkage cracks in the strip. In addition, the upper surface of the sealing portion may be provided with threaded holes for engagement with supporting rods of a lifting, or other manipulation, apparatus.

BRIEF DESCRIPTION OF THE DRAWINGS

These and other features, advantages, and objectives of the present invention will be best understood with reference to the following detailed description of the preferred embodiments thereof, and with reference to the attached drawings in which.

DETAILED DESCRIPTION OF PREFERRED EMBODIMENTS

Figures 1, 2:
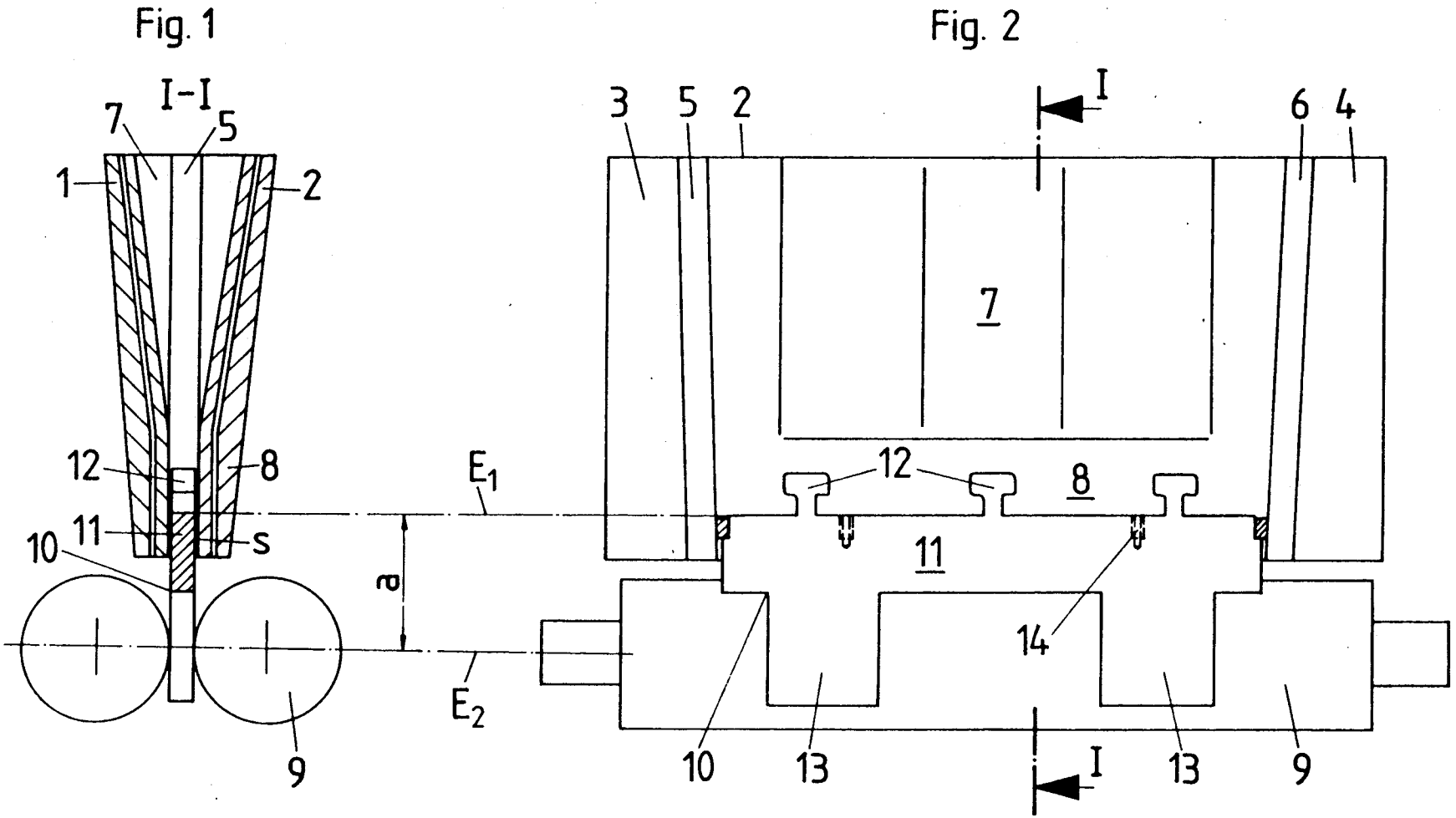
FIG. 1 is an end cross sectional plan view of a strip casting machine showing the strip casting mold, a set of rollers located downstream from the outlet of the mold, and a dummy bar in accordance with the present invention.
FIG. 2 is a front inside view of the device shown in FIG. 1.

Referring now to the drawings, and particularly to FIGS. 1 and 2, two opposing, cooled, broad side walls 1 and 2, and two narrow side walls 5 and 6, arranged between parallel side wall areas 3 and 4 are shown forming the cavity of a strip casting mold. The broad side walls 1 and 2 include an outwardly flared area 7, which is adapted to receive the outlet end of a pouring tube (not shown), and a lower, gradually tapered, strip forming area 8. The cavity formed between broad side walls 1 and 2, and narrow side walls 5 and 6, is, therefore, generally funnel-shaped. An adjustable press roll pair 9 is located below, and in spaced relation to, the outlet of the forming area 8. A set of driven rollers may be used instead of the press roll pair 9, if desired, without departure from the present invention.

The dummy bar 10 in accordance with this invention is shown in its mold sealing position in FIGS. 1 and 2. The bar 10 comprises a one piece steel plate including a sealing portion 11, an upper connecting contour 12, and a lower portion 13 adapted for the support and withdrawal of the strip from the mold. The upper contour comprises several connecting heads so formed that the incoming melt flows and solidifies around the outwardly flared upper portions of the heads in such a way that the forward end of the strip being cast is firmly affixed to the dummy bar 10. The upper end of the sealing portion 11 is maintained in the sealing plane E1 of the mold by sealing means disposed between the left and right sides thereof and the narrow side walls, and by the engagement of the lower portion 13 with the rollers or rolls as described in more detail below. The thickness of the steel plate is 2 to 4 mm smaller than the distance between the broad side walls at the outlet of the forming area 8 of the mold. This results in an on center arrangement of the dummy bar 10 within the forming area 8 as the incoming melt flows around the bar 10, i.e., the broad side walls 1 and 2 respectively define a 1 to 2 mm gap S with the bar 10. Experience with this configuration indicates that this gap is too small to allow significant leakage of melt between the bar 10 and the broad side walls of the mold prior to the solidification of the melt.

The lower portion 13 of bar 10 comprises a pair of parallel strips of plate material separated by open gaps. This allows the overall weight of the device to be reduced without adverse effect upon its ability to support and withdraw the leading end of the cast strip from the mold. Of course, this embodiment is indicative only of the concept of using strips instead of a solid piece of material. Variations in the number of strips formed in the lower portion of the dummy bar ar within the contemplation of the invention in its broadest aspects.

The minimum length of the dummy bar, measured from the upper end of the sealing portion to the bottom of the lower portion, is equal to the spacing between the common plane E2 of the axles of press roll pair 9 and the sealing plane E1 of the mold. The sealing plane E1 is located in the lower area of the mold.

The manipulation of the dummy bar 10 is achieved by the use of a lifting appliance (not shown) whose threaded support rods are screwed into threaded holes 14 in the upper surface of the sealing portion 11. Accordingly, it will be understood that in use the dummy bar 10 is lowered into the mold cavity until the lower end of the lower portion 13 is seized by the first roller or roll pair 9. At that point the upper end of the sealing portion either will, or can be made to, coincide with the sealing plane E1 of the mold. The seals between the left and right sides of the bar and the narrow side walls along with the engagement of the lower portion with the rollers or rolls, will tend to maintain the desired configuration. After melt is introduced into the mold through the pouring tube and a loadable connection is established between the upper contour 12 of the dummy bar 10 and the forward end of the cast strip, the roller or roll pair 9 is activated to withdraw the bar 10 and the supported forward end of the cast strip from the mold.

Figure 3:
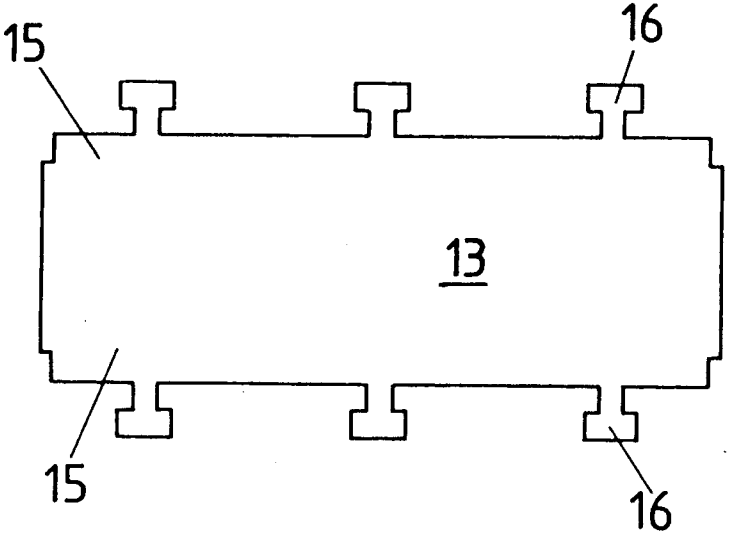
FIG. 3 is a plan view of a dummy bar in accordance with the present invention showing a connection contour formed at both the upper and lower ends of the sealing portion.

FIG. 3 shows an alternative form of dummy bar in accordance with this invention. In this alternative, connecting heads 16 extend both upwardly from the upper end and downwardly from the lower end of the sealing portion 15. While the embodiment of the invention shown in FIGS. 1 and 2 is particularly adapted for one-time use, this embodiment can be used twice without the need for time consuming procedures for the removal of the cast strip from its connection to the dummy bar. The first strip simply is separated from the bar by the same machinery used to cut the strip to length, and the bar reversed for the start of a subsequent strip casting.

Figure 4:
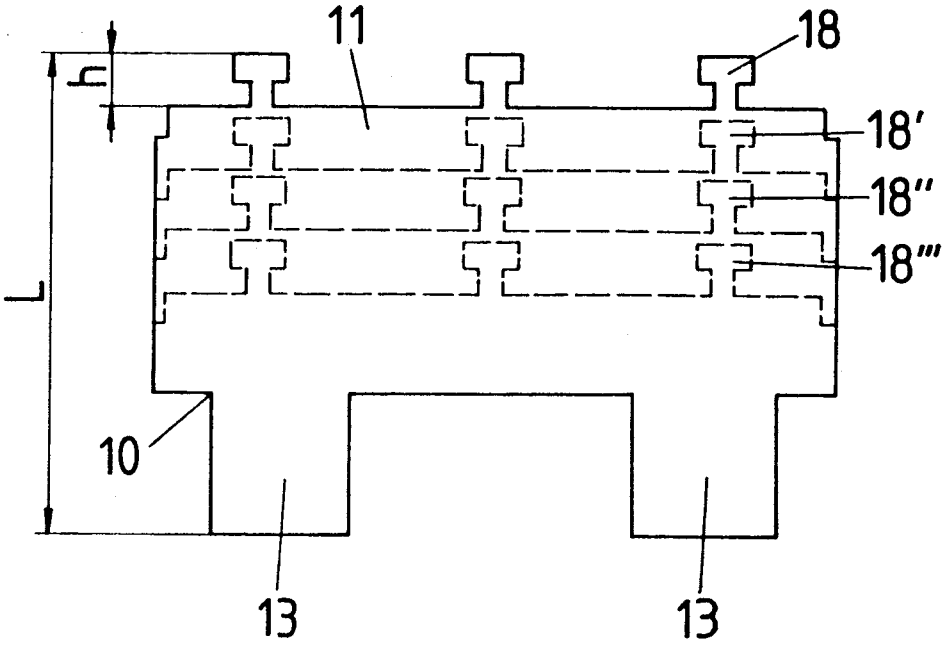
FIG. 4 is a plan view of a dummy bar in accordance with the present invention wherein the length of the bar is chosen so as to allow multiple connection contours to be formed successively therein.

FIG. 4 shows another alternative of the present invention adapted for multiple uses. In this case, after each separation of a cast strip from the bar by the standard cut-to-length machinery, a new connection contour, 18, 18', 18'', 18''', and so on, is sequentially created by flame cutting the new contour immediately below the level of the prior contour. To accomplish this, the initial length of the bar is selected according to the number of uses desired according to the formula $L=a+(n\times h)$, wherein a indicates the spacing between planes E1 and E2, n indicates the number of uses desired, and h indicates the height of the connection contour to be utilized.

Figure 6:
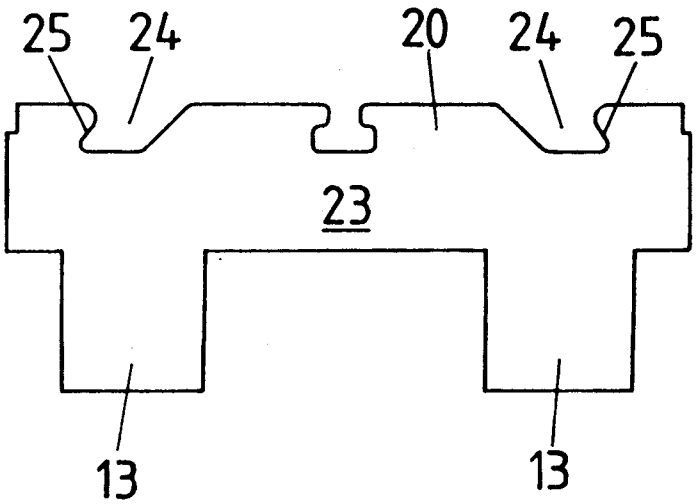
Figure 5:
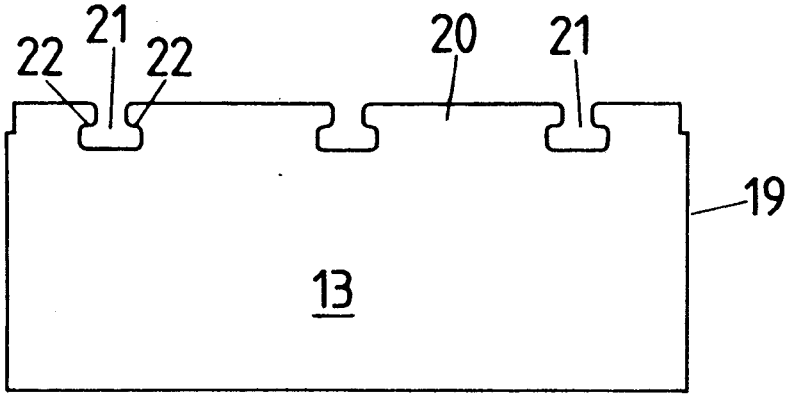
FIG. 5 shows a dummy bar in accordance with the present invention wherein cut outs in the upper end of the sealing portion comprise the connection contour of the device; and, FIG. 6 shows an alternative configuration of the connection contours shown in FIG. 5.

Finally, FIGS. 5 and 6 show another alternative dummy bar in accordance with the present invention wherein the connection contour is formed in the upper end of the sealing portion. Thus, as shown in FIG. 5, the dummy bar 19 is provided with a series of cut outs 21 in the upper end 20 of the sealing portion. In the case shown, the cut-outs 21 display undercuts 22 for the purpose of assuring a secure connection between the dummy bar and the forward end of the strip being cast. For the avoidance of shrinkage cracks in the cast strip, we have found that it is sometimes desireable to slant the inner sides of the cut-outs 24 inwardly toward the longitudinal axis of the bar 10, as shown in FIG. 6. The cut outs 24 therefore display undercuts 25 only on the sides thereof located adjacent the left and right sides of the bar 10 in order to allow the strip to shrink freely as it cools without damage.

Having thus described the preferred embodiment of the present invention, it should be obvious to those skilled in the art that various modifications and alterations are possible without departure from the spirit and scope of the invention in its broader aspects. Such obvious modifications and alterations are intended to be included within the scope of the invention which is not to be limited by the above discussion of the preferred embodiments thereof. The only limitations upon the scope of the invention are defined by the appended claims or their equivalents.

What is claimed is:

1. A method for the sequential use of a dummy bar in the casting of steel strips in a steel strip casting machine which includes a mold defining an upper area and a lower area between a pair of broad side walls and a pair of narrow side walls, said lower area having a sealing plane, and at least a first set of driven rollers or rolls located in spaced relation to and downstream of the outlet of said mold, comprising the steps of:

a) forming a one piece dummy bar having a first upper connection contour of a height (h), a sealing portion having an upper end, and a lower portion having a bottom end such that the length of said bar measured from the upper end of the sealing portion to the bottom end of said lower portion is given by the formula $L=a+(n\times h)$, where a is the distance between the sealing plane of the mold and the plane containing the axles of the first roller pair, and n is the number of sequential uses to which the dummy bar is to be put;

b) placing said dummy bar in said steel strip casting machine such that the upper end of said sealing portion lies in said sealing plane of said mold and said lower portion of said bar engages said first roller pair;

c) introducing melt into said wide portion of said mold until the desired casting level of melt in said mold is attained and a loadable connection between said upper contour of said bar and the forward end of the first strip being cast is created;

d) withdrawing said dummy bar and said forward end of said first strip from said mold at least until said strip engages said rollers directly;

e) cutting said first strip adjacent said dummy bar to separate said bar therefrom;

f) forming a modified dummy bar by flame cutting a second connection contour immediately below said first connection contour in said sealing portion of said dummy bar, thereby removing said first connection contour and the forward end of said first cast strip attached thereto from said dummy bar; and g) casting a second strip utilizing said modified dummy bar.

2. Combined apparatus for the start-up of steel strip casting comprising:

an ingot mold having a pair of substantially parallel broad side walls and a pair of substantially parallel narrow side walls defining a mold cavity including an upper pouring portion, and a lower strip forming portion having a sealing plane and an outlet;

at least a first set of driven rollers or rolls located in spaced relation to, and downstream of, the outlet of said mold cavity; and a dummy bar having a left side and a right side and a cross section substantially the same shape as, but of slightly smaller dimensions than, the cross section of the outlet of said mold cavity;

said dummy bar comprising a one-piece steel plate including a sealing portion having a contoured upper end with a plurality of undercut cut-outs in the upper end of the sealing portion, the cut-outs adjacent the left and right dummy bar sides being undercut only adjacent the left and right dummy bar sides so that the cutouts are adapted for the formation of a cast connection with the forward end of a cast strip, said sealing portion being adapted for removable disposition within the lower strip forming portion of the cavity of said mold, and a lower portion having a bottom end, the distance between said upper end of said sealing portion and the bottom end of said lower portion being greater than the distance between said sealing plane and the axles of said driven set of rollers or rolls, whereby said lower portion may engage said rollers or rolls for the withdrawal of said strip from said mold cavity while said upper end is located within said lower portion of said mold cavity above said sealing plane.

3. Combined apparatus for starting up a steel strip casting operation, said apparatus comprising:

a steel strip casting mold having a pair of opposing, substantially-parallel broad side walls, a first narrow side wall defining a first mold end and a second narrow side wall positioned substantially parallel to said first narrow side wall defining a second mold end, said broad side walls and said narrow side walls forming a mold cavity having a rectangular cross section;

driving rollers located below said mold for engaging and withdrawing a steel strip from said mold; and a one-piece steel plate dummy bar with an upper portion placed in said mold cavity during startup, said upper portion having a first pre-cast connection contour located adjacent to said first mold end and a second pre-cast connection contour located adjacent to said second mold end, said dummy bar further having a lower portion with a first section connected to said upper portion substantially adjacent to said first pre-cast connection contour and a second section connected to said upper portion substantially adjacent to said second pre-cast connection contour, both of said first and said second sections extending to and engaging said driving rollers so that said dummy bar is subjected to drive forces at both said first and said second mold ends whereby said dummy bar is locked to a steel strip forming in said mold by said connection contours and said dummy bar is drawn out of said mold in a straight line by means of said driving rollers engaging said lower dummy bar portion.

4. Combined apparatus according to claim 3 wherein said strip casting mold has an outlet having a width between said pair of broad side walls and said dummy bar upper portion has a thickness which is between 2 mm and 4 mm less than said width.

5. Combined apparatus according to claim 3 wherein each of said first dummy bar section and said second dummy bar section comprises a strip of plate material having an upper end attached to said dummy bar upper portion.

6. Combined apparatus according to claim 3 wherein said dummy bar plate has a lower end opposite said upper portion, said dummy bar lower end containing pre-cast contours which allow for the formation of a cast connection between said dummy bar lower end and a steel strip forming in said mold.

7. Combined apparatus according to claim 3 wherein each of said first pre-cast connection contour and said second pre-cast connection contour comprises a mushroom-shaped connection head projecting perpendicularly from said dummy bar upper portion for a predetermined height.

8. Combined apparatus according to claim 7 wherein said strip casting mold has an outlet and a sealing plane located in said mold adjacent to said outlet and said dummy bar upper portion has means for temporarily sealing said dummy bar upper portion to said mold at said sealing plane.

9. Combined apparatus according to claim 8 wherein said dummy bar is designed for a number of multiple uses and said combined apparatus further comprises means for cutting off part of said dummy bar upper portion to separate said dummy bar from a hardened cast strip and means for forming new connection contours in said dummy bar upper portion after said dummy bar has been separated from said hardened cast strip and said dummy bar further has a length (L) determined by the relation $L=a+(n\times h)$ where (a) is a distance from said sealing plane to said driving rollers, (n) is said number of multiple uses and (h) is said connection head height.

10. Combined apparatus according to claim 3 wherein each of said first pre-cast connection contour and said second pre-cast connection contour comprises a mushroom-shaped connection cutout extending inwardly from said dummy bar upper portion towards said dummy bar lower portion.

11. Combined apparatus according to claim 3 wherein each of said first pre-cast connection contour and said second pre-cast connection contour comprises a cutout slot extending inwardly from said dummy bar upper portion towards said dummy bar lower portion and angled toward a longitudinal edge of said dummy bar.

12. Combined apparatus according to claim 3 further comprising means for hoisting said dummy bar into position in said strip casting mold and said dummy bar upper portion further comprises means for attaching said hoisting means to said dummy bar upper portion.

* * * * *